United States Patent [19]

Nagahara et al.

[11] 4,231,653

[45] Nov. 4, 1980

[54] OIL SUPPLY APPARATUS

[75] Inventors: Yasumori Nagahara, Yokosuka; Haruki Iida, Tokyo, both of Japan

[73] Assignee: Ricoh Company, Ltd., Japan

[21] Appl. No.: 964,381

[22] Filed: Nov. 28, 1978

[30] Foreign Application Priority Data

Nov. 30, 1977 [JP] Japan ..... 52-144478

[51] Int. Cl.[3] ..... G03G 15/00

[52] U.S. Cl. ..... 355/3 FU; 118/60; 118/DIG. 1; 219/216

[58] Field of Search ..... 355/3 FU; 118/DIG. 1, 118/60, 258–260, 70; 432/60; 219/216, 388 W

[56] References Cited

U.S. PATENT DOCUMENTS

| | | | |
|---|---|---|---|
| 1,956,197 | 4/1934 | Lines | 118/259 X |
| 2,590,538 | 3/1952 | Huck | 118/259 X |
| 3,880,577 | 4/1975 | Tomono et al. | 432/60 |
| 3,883,291 | 5/1975 | Cloutier et al. | 118/60 X |
| 3,918,804 | 11/1975 | Bar-on | 355/3 FU |
| 3,941,085 | 3/1976 | Hattler et al. | 118/60 |
| 3,964,431 | 6/1976 | Namiki | 118/60 |
| 3,970,038 | 7/1976 | Thettu | 118/60 |
| 3,981,269 | 9/1976 | Watahiki | 118/60 |
| 3,989,005 | 11/1976 | Bowler et al. | 118/60 |
| 3,999,510 | 12/1976 | Thettu | 118/60 |
| 4,045,165 | 8/1977 | Nakajima et al. | 118/60 X |
| 4,050,801 | 9/1977 | McCarroll | 355/3 FU |
| 4,079,227 | 3/1978 | Takiguchi | 219/216 |
| 4,083,322 | 4/1978 | Beckman | 118/60 X |
| 4,085,702 | 4/1978 | Consaul et al. | 118/60 |
| 4,087,676 | 5/1978 | Fukase | 219/216 |
| 4,136,613 | 1/1979 | Namiki | 118/60 |
| 4,145,599 | 3/1979 | Sakurai | 219/216 |
| 4,149,485 | 4/1979 | Okamoto et al. | 118/60 |

*Primary Examiner*—R. L. Moses

*Attorney, Agent, or Firm*—McGlew and Tuttle

[57] ABSTRACT

An oil supply apparatus for use with copying machines comprises a tank for holding an offset preventing oil therein, a pump for sucking the oil from the tank, a container for holding the sucked oil therein, an oil application device for applying the oil taken from the container to an image fixing roller and an oil recovery means device for recovering an excessive amount of the oil which was taken from the container and returning it to the tank. The oil is always circulated in the oil supply apparatus and the container can be detached from the tank. When the container is detached from the tank, a stopper is engaged in a drain hole formed in the container concurrently with the detachment action so as to prevent the oil from being spilled.

20 Claims, 21 Drawing Figures

OIL SUPPLY APPARATUS

BACKGROUND OF THE INVENTION

The present invention relates to an oil supply apparatus for use with copying machines.

In a copying machine in which image fixing is effected by rollers, it is necessary to coat an offset preventing oil, such as silicon oil (hereinafter simply referred to as the oil), on an image fixing roller in order to prevent the offset of toner images.

Conventionally, an oil tank for holding the oil therein is located near a heated image fixing roller. Therefore, the oil in the tank is heated and evaporated and deteriorated, with the viscosity of the oil changing during storage of the oil in the tank, so that after a time, a desired offset preventing effect cannot be obtained from the oil. In order to remove such a shortcoming of the conventionl oil tank, an improved oil supply apparatus is known, in which the oil tank is located at a position away from the image fixing roller and a reservoir for holding a predetermined amount of the oil is located between the oil tank and the image fixing roller. The oil is supplied from the reservoir to the image fixing roller and as the oil in the reservoir is decreased, the oil is replenished from the oil tank into the reservoir. However, even in the case of this oil supply apparatus, the oil stays in the reservoir for a comparatively long time and it is inevitable that the oil is heated and evaporated and that the properties of the oil are changed. Furthermore, when the copying machine is moved, the oil tank has to be detached from the copying machine and the reservoir has to be evacuated.

SUMMARY OF THE INVENTION

It is therefore an object of the present invention to provide an oil supply apparatus for use with copying machines, in which a necessary minimum amount of oil is placed in the oil container in order to obviate the unnecessary evaporation of the oil and the oil is circulated so as not to be heated.

The object of the present invention can be attained by an oil supply apparatus comprising a tank for holding the oil, a pump for sucking the oil from the tank, an oil container for holding the sucked oil, an oil application means for applying the oil from the container to an image fixing roller, the oil application means being disposed between the oil container and an image fixing roller, and an oil recovery means for recovering an excessive amount of oil from the container and returning it to the oil tank.

According to the present invention, the oil tank and the oil container are separated, and the oil is intermittently sucked into the oil container by the pump. A necessary minimum amount of oil is held in the oil container and excessive oil is recovered from the oil container into the oil tank, so that the oil is always circulated, whereby the situation is prevented that the oil is evaporated or deteriorated by heat applied thereto.

According to the present invention, the oil suction pump is operated when the copying machine is on standby, so that the oil is supplied to the image fixing roller continuously and the offset of toner images can be prevented from the first copy.

Further, according to the present invention, a drain hole formed in the oil container, which is connected to an oil recovery means, is closed cooperatively with the pulling-out operation of the oil container from the copying machine, so that spilling of the oil from the oil container is prevented.

In addition according to the present invention, the oil container and the oil tank are separated, and there is a necessary minimum oil in the oil container, so that the oil is not spilled from the oil container when the copying machine is moved.

BRIEF DESCRIPTION OF THE DRAWINGS

For a better understanding of the invention as well as other objects and further features thereof, reference is had to the following detailed description of the invention to be read in connection with the accompanying drawings, wherein.

DETAILED DESCRIPTION OF THE PREFERRED EMBODIMENT

Figure 1:
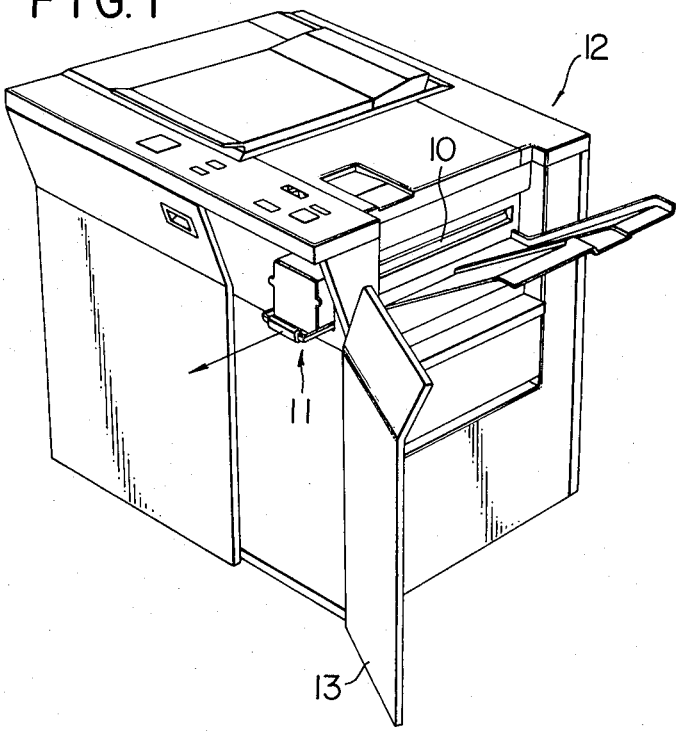
FIG. 1 is a perspective view of a copying machine employing an embodiment of an oil supply apparatus according to the present invention.
Figure 2:
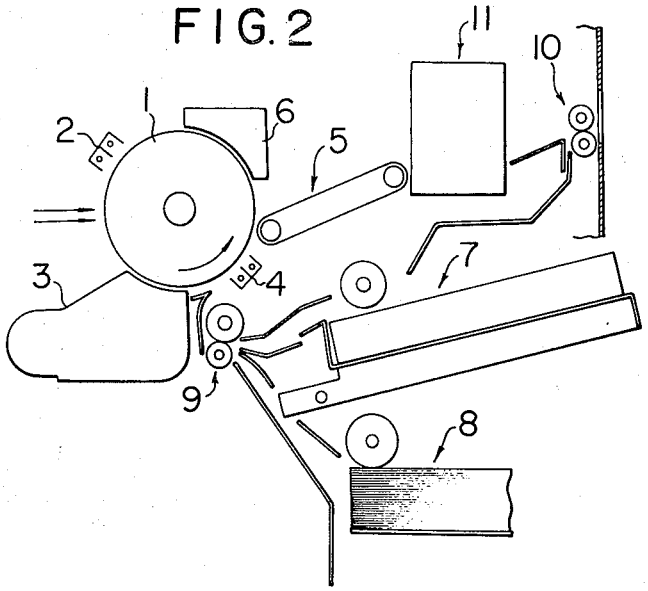
FIG. 2 is schematic sectional view of the copying machine of FIG. 1 showing the outline of the construction of the copying machine.

Referring to FIG. 1, there is shown a perspective view of a copying machine employing an oil supply apparatus according to the present invention. FIG. 2 is a schematic sectional side view of the copying machine of FIG. 1, showing the mechanism of the copying machine. In FIG. 2, reference numeral 1 represents a photoconductor drum which is rotated in the direction of the arrow. Around the photoconductor drum 1, there are arranged a charging apparatus 2, a development apparatus 3, an image transfer apparatus 4, a recording sheet separation and transportation apparatus 5 and a cleaning apparatus 6. On the surface of the photoconductor drum 1 between the charging apparatus 2 and the development apparatus 3, a light image of an original is projected by an exposure apparatus (not shown). A recording sheet is selectively discharged from either a first sheet feed apparatus 7 or a second sheet feed apparatus 8 and is brought into contact with the peripheral surface of the photoconductor drum 1 between the development apparatus 3 and the image transfer apparatus 4 by a pair of register rollers 9. An image fixing apparatus 11 is disposed between the recording sheet separation and transportation apparatus 5 and sheet discharge rollers 10.

Since the operation of the copying machine of this type is well known, an explanation thereof is omitted here.

The image fixing apparatus 11 is provided with an oil supply apparatus according to the present invention. As is shown in FIG. 1, the image fixing apparatus 11 can be slid out of the body 12 of the copying machine by opening a door 13.

Figures 3, 5:
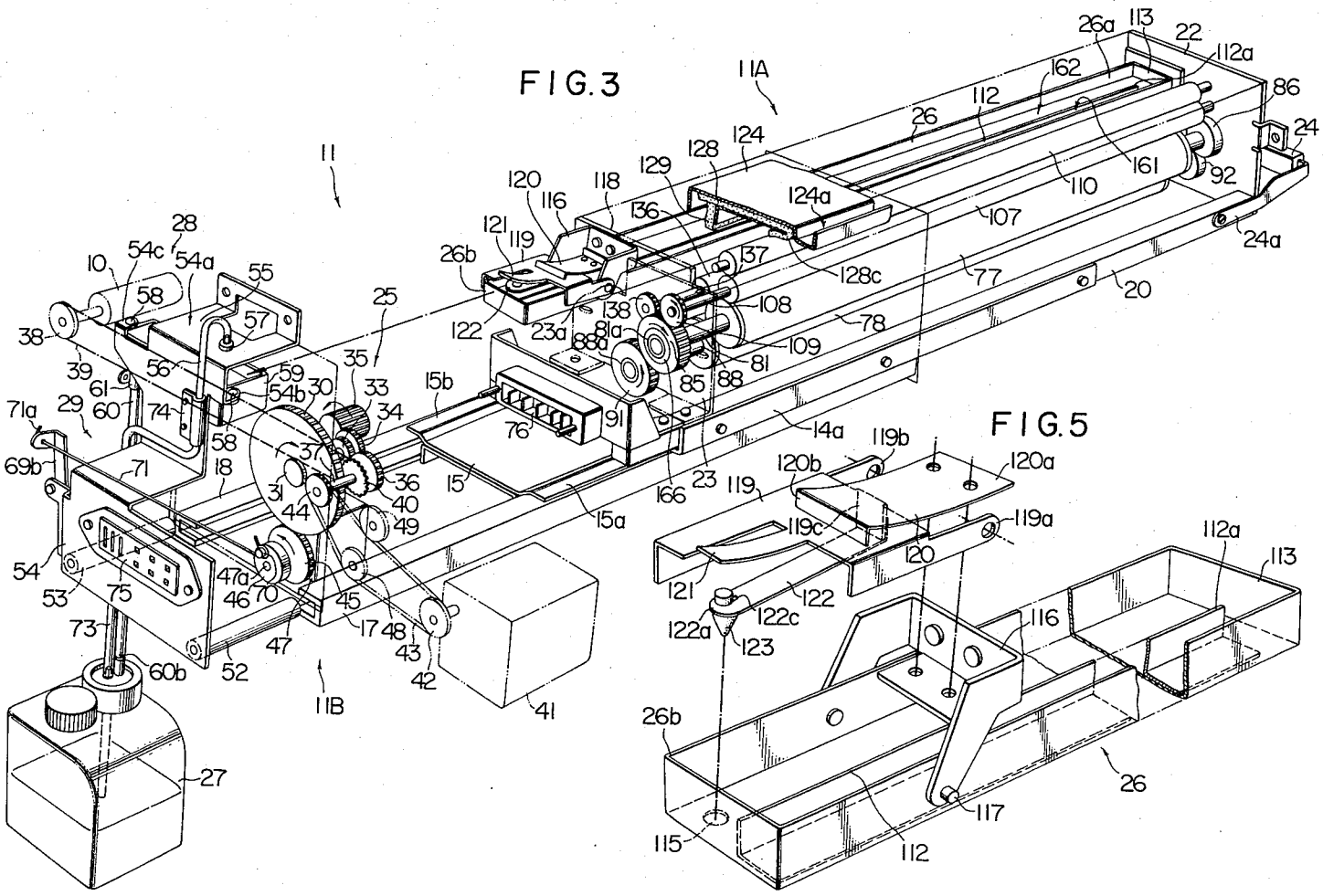
FIG. 3 is a schematic perspective view of an image fixing apparatus employing the embodiment of the oil supply apparatus according to the present invention.
FIG. 5 is a perspective exploded view of a main portion of an oil container of the oil supply apparatus according to the present invention.
Figure 4:
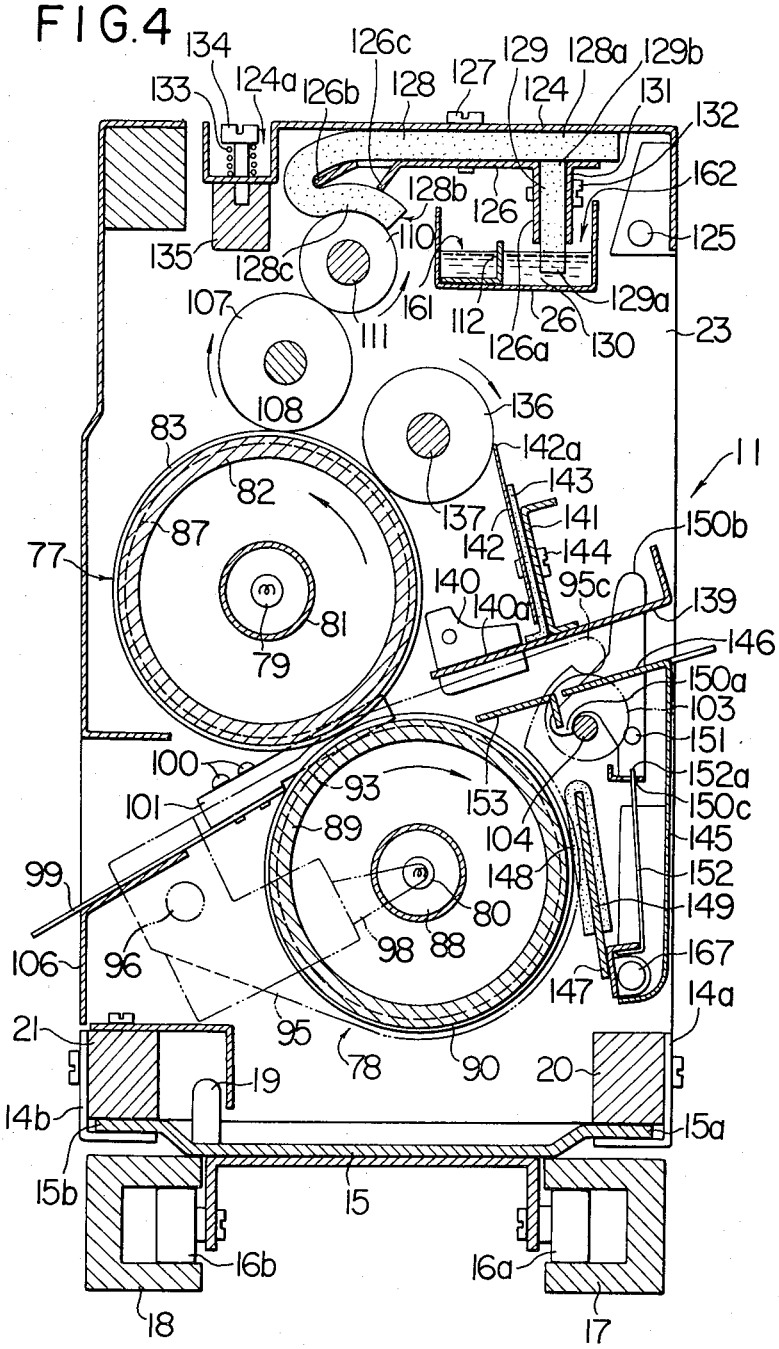
FIG. 4 is a schematic sectional view of FIG. 3.
Figure 10:
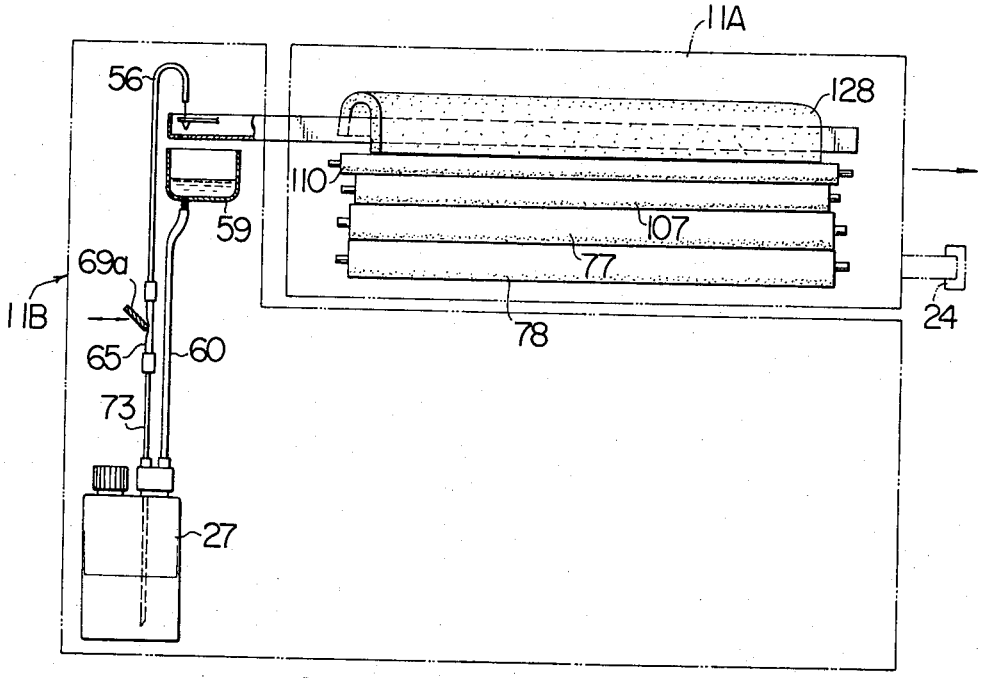
FIG. 10 is a schematic illustration of the circulation path of the oil in the oil supply apparatus according to the present invention.

Referring to FIGS. 3 and 4, the image fixing apparatus 11 will now be explained. In broad outline, the image fixing apparatus 11 comprises a movable mechanical portion (hereafter referred to as "movable mechanical portion 11A") which can be drawn out of the body 12 of the copying machine and a stationary mechanical portion (hereafter referred to as "fixed mechanical portion 11B") which is fixed to the body 12 of the copying machine (refer to FIG. 10).

Movable rails 14*a* and 14*b*, which are respectively fixed to frames 20 and 21 of the movable mechanical portion 11A, slidably hold the opposite sides 15*a* and 15*b* of an intermediate rail 15, respectively, so that the movable mechanical portion 11A fixed to the frames 20 and 21 is slidable on the intermediate rail 15. The intermediate rail 15 has guide rollers 16*a* and 16*b* on opposite sides thereof which are fitted in fixed guide rails 17 and 18 fixed to the body of the copying machine. The movable rails 14*a* and 14*b*, the intermediate rail 15 and the fixed guide rails 17 and 18 constitute a three-step slide rail. The intermediate rail 15 can be drawn 59 almost half of its length relative to the fixed guide rails 17 and 18 and the movable rails 14*a* and 14*b* can be drawn to almost half their length relative to the intermediate rail 15. Therefore, the movable mechanical portion 11A to which the movable rails 14*a* and 14*b* is connected, can be drawn almost its entire length and almost wholly from the body of the copy machine to the front portion of the copy machine. Referring to FIG. 4, reference numeral 19 represents a stopper means which is fixed to the intermediate rail 15 and serves to regulate a pulled-out position of the movable rails 14*a* and 14*b*. There is not shown a stopper for regulating a pulled-out position of the intermediate rail 15 relative to the fixed rail 17 and 18. The movable rails 14*a* and 14*b* and the intermediate rail 15 are designed so as to be detachable from each other, so that the movable mechanical portion 11A can be detached from the body of the copy machine.

To the opposite ends of the frames 20 and 21 of the movable mechanical portion 11A, there are respectively fixed end plates 22 and 23. Between the end plates 22 and 23, there are disposed members which constitute a main portion of a development apparatus, such as an oil container 26 and image fixing rollers as will be described in detail. At one end portion of each of the frames 20 and 21, there is provided a handle 24 for moving the movable mechanical portion 11A.

Figures 7, 8, 9:
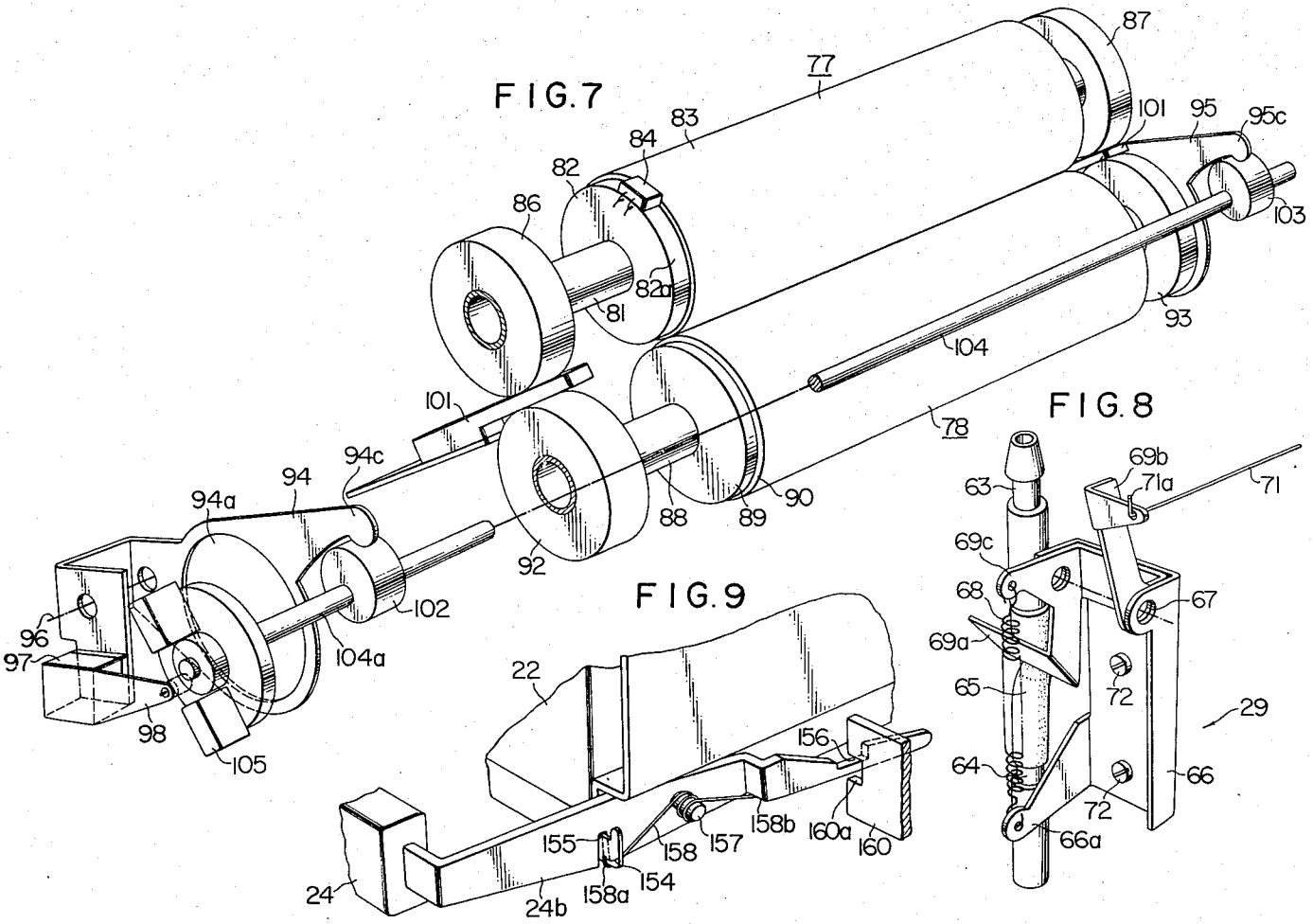
FIG. 7 is a perspective view of a means for bringing an image fixing roller and a pressure application roller into pressure contact with each other for use in the oil supply apparatus according to the present invention.
FIG. 8 is a perspective view of an oil sucking pump for use in the oil supply apparatus according to the present invention.
FIG. 9 is a partial perspective view of a holding means for holding a movable mechanical portion of the oil supply apparatus according to the present invention at a pushed-in position.

On the other hand, the fixed portion 11B comprises the fixed guide rails 17 and 18, a driving apparatus or means 25 which is disposed at a back end portion of the fixed guide rails 17 and 18, an oil tank 27 for holding oil therein, an oil recovery means 28 and an oil suction pump 29 (refer to FIG. 8).

Figure 11:
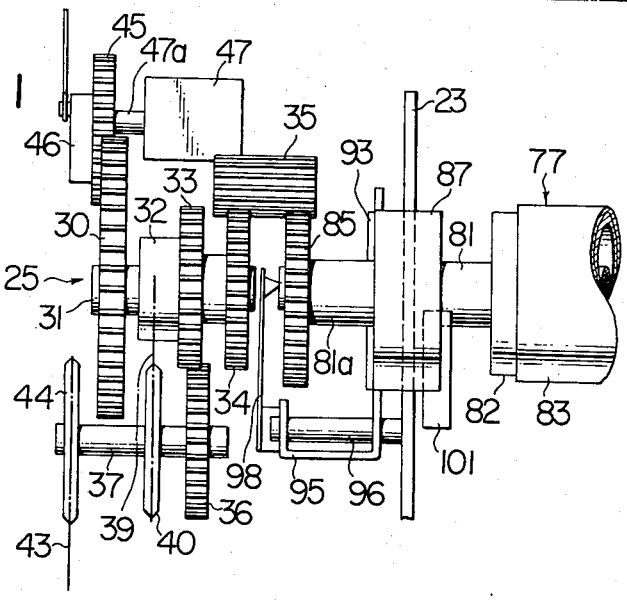
FIG. 11 is a partial enlarged view of a driving apparatus for use in the oil supply apparatus according to the present invention.

Referring to FIG. 11, there is partly shown in detail the driving apparatus 25 which comprises a large diameter gear 30, a gear 33 and gear 34 which are mounted on a shaft 31 of the large diameter gear 30 through a oneway clutch 32, a gear 36 which is engaged with the gear 33 and is fixedly mounted on a shaft 37, a sprocket wheel 40 which is fixedly mounted on the shaft 37 and which is connected with a sprocket wheel 38 by a chain 39, the sprocket wheel 38 rotatable together with the sheet discharge roller 10 (see FIG. 2), a sprocket wheel 44 which is fixedly mounted on the shaft 37 and which is connected to a sprocket wheel 42 of a main motor 41 of the copying machine by a chain 43 through an idle sprocket 48 and a tension sprocket 49, a gear 45 which is engaged with the large diameter gear 30, a pump operation disc 46 which is substantially integral with the gear 45, and a standby motor 47 having a rotation shaft 47*a* on which the gear 45 and the disc 46 are fixedly mounted. The one-way clutch 32 conveys the rotation of the shaft 31 to the gears 33 and 34, but does not convey the rotation of the gears 33 and 34 to the shaft 31.

The standby motor 47 is designed so as to rotate at a low speed with a main switch (not shown) of the copying machine on. Therefore, so long as the main switch is on, the standby motor 47 rotates the gear 45, the large diameter gear 30, the gears 33 and 34, the gear 35, the gear 36, the sprocket wheels 40 and 44 which are rotatable integrally with the gear 36, and the sheet discharge roller 10 at a low speed.

The main motor 41 for driving the photoconductor drum 1 (refer to FIG. 2) and the other members are designed to be rotated at least until a copy sheet is discharged by the sheet discharge rollers 10 after the copying operation is started by depressing a print button (not shown). The main motor 41 serves to rotate the sprocket wheels 44 and 40, the gear 36, the gears 33 and 34, and the gear 35. The rotation of the main motor 41 is by far faster than that of the standby motor 47, and the rotation of the main motor 41 is not transmitted to the large diameter gear 30 by the action of the one-way clutch 32.

The main motor 41 and the standby motor 47 are fixed to an immovable member (not shown), and a shaft (not shown) of the gear 35, the shaft 31 and the shaft 37 are respectively supported on immovable members (not shown).

Figure 13:
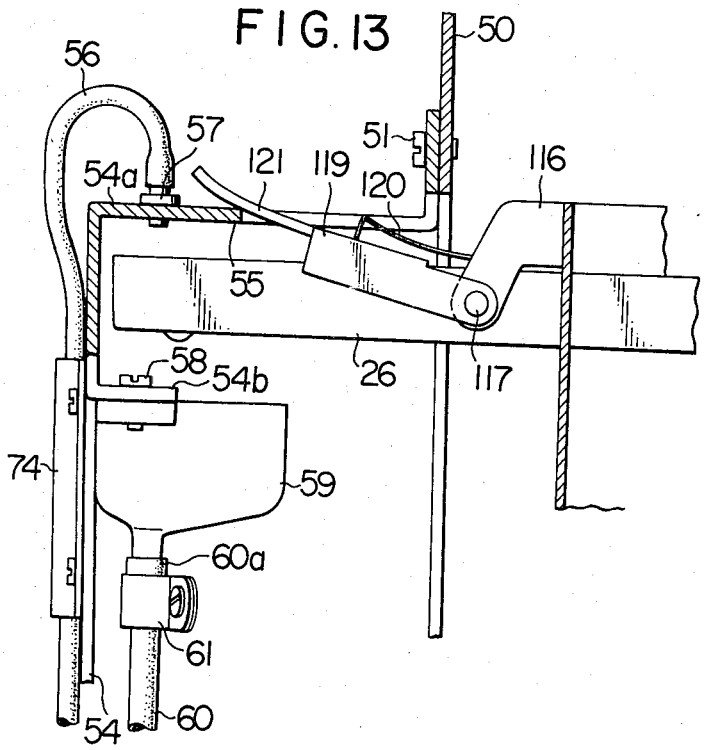
FIG. 13 is a schematic sectional side view of the oil container of FIG. 12 when the oil container is positioned at the oil sucking position.

The oil recovery means 28 and the oil suction pump 29 are fixedly supported on a support plate 54 which is fixed to a side plate 50 of the body of the copying machine by a screw 51 (see FIG. 13) and stays 52, 52 (see FIG. 3).

In an upper portion 54*a* of the support plate 54 which is bent as shown in FIG. 3, there is punched a cam 55 with which a cam follower of the movable mechanical portion 11A is engageable as will be explained later.

Figure 6:
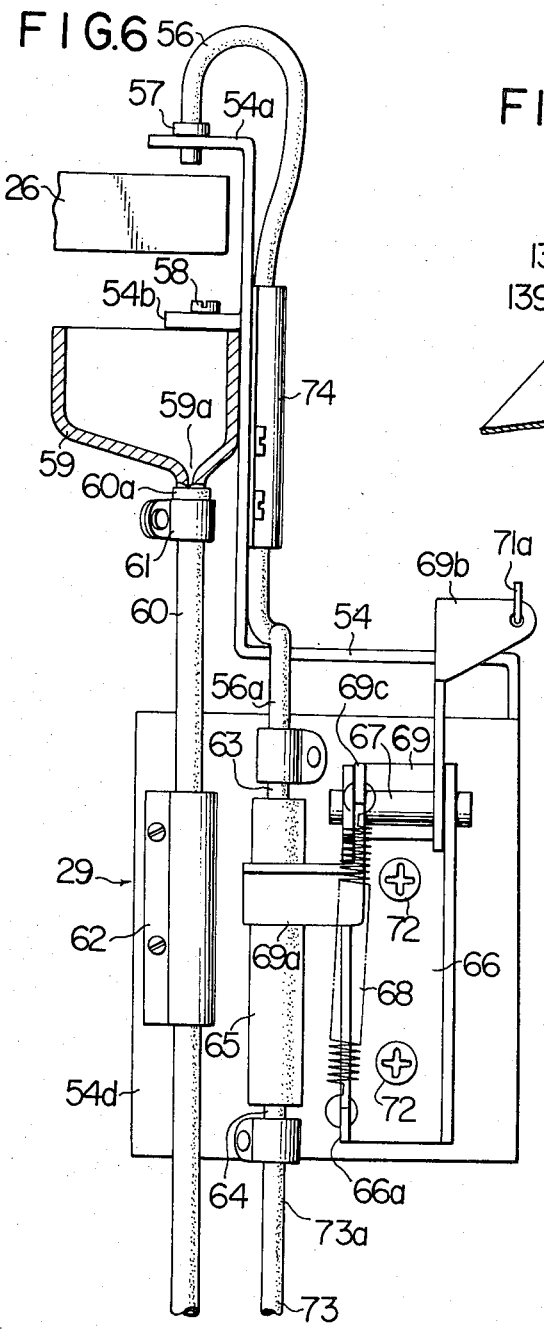
FIG. 6 is a schematic partial sectional view of a pump for sucking the oil and an oil recovery apparatus of the oil supply apparatus according to the present invention.

Through the upper portion 54*a* of the support plate 54, there is fixedly passed an outlet portion 57 of an oil supply pipe 56 whose other end is connected to the oil suction pump 29 (see FIG. 6).

Under the outlet portion 57, there is disposed an oil recovery funnel or container 59 which is fixed to bent portions 54*b* and 54*c* of the support plate 54 by screws 58. The upper portion of the oil recovery container 59 is open, and to the lower portion of the oil recovery container 59, there is connected one end 60*a* of a drain pipe 60 by a clamping member 61. A middle portion of the drain pipe 60 is fixed to a vertical pump support portion 54*d* (refer to FIG. 6) of the support plate 54 by a holding member 62 and the other end 60*b* of the drain pipe 60 is inserted into the oil tank or container (see FIG. 3).

The oil container 27 is supported on an immovable member through a holding member (not shown).

The oil suction pump 29 is supported by a pump support portion 54*d* (see FIG. 6) of the support plate 54. As shown in FIG. 8, the oil suction pump 29 comprises a pair of tubes 63, 64 having check valves therein (not shown), a flexible tube 65 made of a highly resilient material, such as a urethane rubber, which connects the tube 63 to the tube 64, a pressing member 69 which is biased to press the flexible tube 65, and an operation rod 71 capable of swinging the pressing member 69 against the bias thereof.

To the pipe 64, there is connected one end 73*a* of a pipe 73 whose other end is substantially inserted to the bottom of the oil container 27 (see FIG. 3). The pressing member 69 is swingably supported on a fulcrum shaft 67 of a support member 69, and by bias of a spring 68 stretched between fixing portions 69*c* and 66*a*, one arm 69*a* of the pressing member 69 is brought into pressure contact with the flexible tube 65. Through the other arm 69*b* of the pressing member 69, there is loosely passed one end portion 71*a* of the operation rod 71 whose other end portion is engaged with a pin 70 secured to an end surface of the pump operation disc (see FIG. 3), and the end portion 71 a is bent so as to be engaged with the arm 69*b*. An end portion 56*a* of the oil supply pipe 56 is connected to the tube 63. The support member 66 is fixed to the pump support portion 54*d* by a screw 72. The arm 69*a* deforms elastically the tube 65 by the bias of the spring 68, so that the oil in the tube 65 is pushed into the tube 63. When the arm 69*a* is moved away from the tube 65 by the operation rod 71 being moved in accordance with the rotation of the disc 46 and the tube 65 goes back to the previous shape, the oil is sucked from the tube 64 into the tube 65.

Deformation of the tube 65 is effected by a slow rotation of the standby motor (see FIG. 3), so that the oil is discharged dropwise intermittently from the outlet portion 57 of the oil supply pipe 56. The oil supply pipe 56 is fixed to the support plate 54 by a fixing member 74.

To the support plate 54, there is fixed a fixed side terminal 75 for a connector for energizing heaters built in the image fixing rollers and the pressure application rollers in the movable mechanical portion 11A.

The construction of the movable mechanical portion 11A will now be explained in detail. Referring to FIG. 3, to the end portion of the frames 20 and 21 (only one frame 20 is shown in FIG. 3), there is fixed a movable side terminal 76 which is engageable with the fixed side terminal 75 when the movable mechanical portion 11A is pushed in. The movable side terminal 76 serves to supply power to a heater 79 of an image fixing roller 77, a heater 80 of a pressure application roller 78 (see FIG. 4) and a control apparatus (not shown).

Referring to FIG. 3, the image fixing roller 77 is rotatably supported between the end plate 22 and the end plate 23. As shown in FIG. 4, the image fixing roller 77 is the so-called heat pipe roller comprising a pipe shaft 81, the heater 79 disposed inside the pipe shaft 81, a core metal 82, a heating insulating elastic layer 83 formed on the peripheral surface of the core metal 82 and a heating medium (not shown) sealed between the pipe shaft and the core metal 82. As shown in FIG. 7, one peripheral end portion of the core metal 82 is not coated with the heat insulating elastic layer 83 and the peripheral surface of the core metal 82 is bare, where a temperature detecting portion 82*a* is formed and a temperature detecting element 84 is in contact with the temperature detecting portion 82*a*. Since an oil coating roller is in contact with the upper portion of the image fixing roller 77 as will be described later, it is improper to dispose the temperature detecting element 84 at such a position as shown in FIG. 7. In FIG. 7, the temperature detecting element 84 is disposed at the position just for convenience of the explanation. On one end portion 81*a* of the pipe shaft 81 of the image fixing roller 77, there is mounted a gear 85 through a one-way clutch 166, such as a spring clutch. As shown in FIG. 7, on the other end portion of the pipe shaft 81 and on the pipe shaft 81 between the gear 85 and the end of the core metal 82, there are respectively fitted a bearing member 87 and a bearing member 86, which are omitted in FIG. 3 for simplification of the figure.

The respective diameters of the bearing members 86 and 87 are set smaller than that of the core metal 82.

The image fixing roller 77 is rotatably supported by the bearing members 86, 87 which are fitted into the end plates 22, 23. The gear 85 of the image fixing roller 77 is engageable with a gear 35 of the driving apparatus 25 of the fixed mechanical portion 11B. The details of the gear 85 will be explained later.

Under the image fixing roller 77, there is disposed the pressure application roller 78 which is the so-called heat pipe roller comprising a pipe shaft 88 in which a heater 80 is disposed, a core metal 89, a teflon layer 90 formed on the peripheral outer surface of the core metal 89, and a heating medium (not shown) sealed between the pipe shaft 88 and the core metal 89. On one end portion 88*a* of the pipe shaft 88, ther is fixed a gear 91 which engages with the gear 85 of the image fixing roller 77 as shown in FIG. 3. Therefore, the pressure application roller 78 is driven through the gear 85, and the image fixing roller 77 which is in pressure contact with the pressure application roller 78 is driven by the pressure application roller 78.

As shown in FIG. 7, bearing members 92 and 93 are fitted on the pipe shaft 88 and are loosely fitted in holes (not shown) formed in the end plates 22, 23 so as to be movable in the radial direction of the pipe shaft 88, and further inserted into support holes 94*a*, 95*a* (see FIGS. 7 and 17) of a pair of support arms 94, 95 and supported by the support arms 94, 95.

The support arms 94, 95 are rotatably mounted on the end plates 22, 23 (not shown) through a stud 96 (see FIGS. 7 and 11). As shown in FIG. 7, to each of the support arms 94, 95, there is fixed an arm 98 for supporting the heater 80 thereby with a heat insulating member 97 inserted therebetween.

In case the diameters of the respective bearing members 92 and 93 of the pressure application roller 78 are set larger than that of the pressure application roller 78, the pressure application roller 78 can be easily pulled out in the axial direction thereof.

Between the bearing members 86, 87 of the image fixing roller 77 and the bearing members 92, 93 of the pressure application roller 78, there are disposed spacers 101 (see FIGS. 7 and 11) which are fixed to the opposite sides of a recording sheet guide member 99 by screws 100 (where the transportation of recording sheets is not prevented). The recording sheet guide member 99 is fixed to a side plate 106 on a recording sheet inlet side of the movable mechanical portion 11A. The thickness of the spacers 101 is set smaller than the sum of the radii of the image fixing roller 77 and the pressure application roller 78 less the sum of the radii of the respective bearing members 86 and 92 (or 87 and 93).

Therefore, when the bearings 86, 92, 87 and 93 are brought into pressure contact with the opposite sides of the spacers 101, the heat insulating elastic layer 83 of the image fixing roller 77 is also brought into pressure contact with the teflon layer 90 of the pressure application roller 78.

The support arms 94, 95 are respectively provided with cam contact members 94*c*, 95*c* (see FIG. 7). Eccentric cams 102, 103 are respectively in contact with the cam contact members 94*c*, 95*c* and are fixed to a support shaft 104 which is rotatably supported between the end plates 22, 23 of the movable mechanical portion 11A. To an end portion 104*a* of the support shaft 104, which is projected from the end plate 22, there is fixed a knob 105 for rotating the eccentric cams 102, 103.

Figure 17:
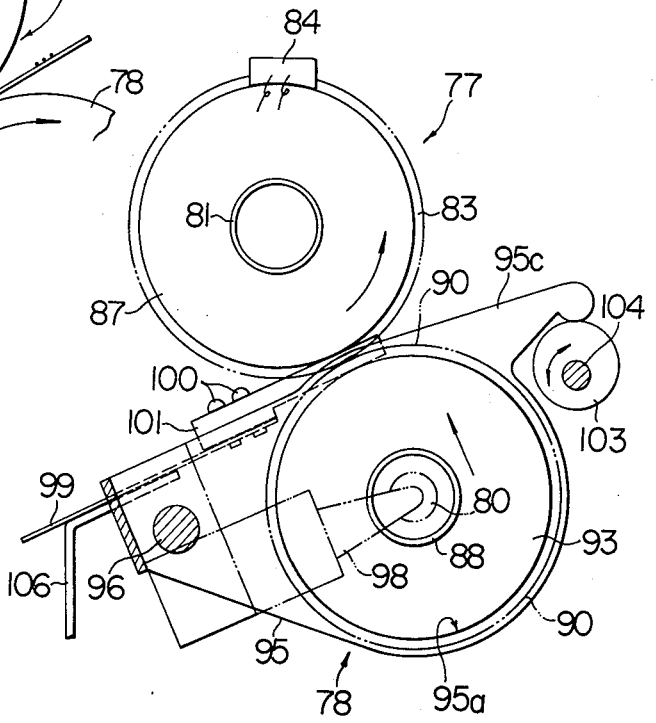
FIG. 17 is a schematic sectional side view of the image fixing roller and the pressure application roller for use with the oil supply apparatus of the present invention.

When the eccentric cam 103 is rotated clockwise by rotating the knob 105 as shown in FIG. 17, the eccentric cam 103 swings the support arm 95 counterclockwise about the stud 96 through the cam contact member 95*c*. By the swinging of the support arm 95, the teflon layer 90 of the pressure application roller 78 which is supported by the support arm 95 is brought into pressure contact with the heat insulating elastic layer 83 of the image fixing roller 77. The contact pressure between the image fixing roller 77 and the pressure application roller 78 is kept constant by the spacers 101 held between the bearings 87 and 93 and between the bearings 86 and 92. The positions of the eccentric cams 102, 103 are determined since the contacts points of the cam contact members 94*c*, 95*c* with the eccentric cams 102, 103 are in the swinging locus of the support arms 94, 95, which passes through the support shaft 104.

On the image fixing roller 77, there is disposed an oil application roller 107. The oil application roller 107 is fitted on a shaft 108 which is rotatably supported by slots (not shown) formed vertically in the end plates 22, 23 (see FIG. 3). The oil application roller 107 is in contact with the image fixing roller 77. On one end of the shaft 108, there is mounted a gear 109 (see FIG. 3), which engages with the gear 85 of the image fixing roller 77, through a one-way clutch (not shown). The oil application roller 107 is driven by the gear 85 of the image fixing roller 77. The oil application roller 107 comprises a metallic roller whose surface is coated with Teflon S (trademark).

On the oil application roller 107, there is disposed an oil supply roller 110 whose shaft 111 is supported by slots (not shown) formed vertically in the end plates 22, 23. The peripheral surface of the oil supply roller 110 is coated with an oil resistant silicone rubber and the oil supply roller 110 is brought into pressure contact with the oil application roller 107 by an oil supply wick or felt as will be described in detail.

Between the end plates 22, 23 of the movable mechanical portion 11A, there is supported an oil container 26 (see FIG. 3). One end portion 26*a* of the oil container 26 is fixed to the end plate 22 and the other end portion 26*b* of the oil container 26 is fixed to an indented portion 23*a* of the end plate 23. In the oil container 26, there is disposed a partition plate 112 in the longitudinal direction of the oil container 26, with one end 112*a* of the partition plate 112 spaced apart from an end plate 113 of the oil container 26 (see FIGS. 5 and 12). The partition plate 112 forms oil courses 161, 162 by separating the oil container 26 into two as indicated by the arrows in FIG. 12.

The oil discharged from the oil outlet portion 57 is dropped to a starting end portion 114 of the oil course 161 and flows in the direction of the arrows, passing through the oil courses 161, 162, and when a drain hole 115 (see FIGS. 5 and 12) is opened, the oil is dropped from the drain hole 115 into the oil recovery container 59 which is disposed under the drain hole 115.

As shown in FIG. 5, to a projecting end portion of the coil container 26, there is fixed a support member 116 by a pair of pins 117 (only one pin is shown in FIG. 5). The support member 116 is fixed to the end plate 23 through an attachment plate 118. On the pins 117, there are swingably mounted two legs 119*a*, 119*b* of a cam device 119. A free end 120*b* of a flap spring 120, whose base end 120*a* is fixed to the support member 116, is brought into pressure contact with an upper surface of the cam follower device 119. In the cam follower device 119, there is formed a cam follower 121 which is bent upwards and engageable with the cam 55. To a downwards extending portion 119*c* of the cam follower device 119, there is fixed a base end portion 122*b* of an elastic plate 122 by screws 124*c*. The elastic plate 122 supports a stopper 123 at a top portion 122*a* thereof (see FIGS. 5 and 15).

Figure 15:
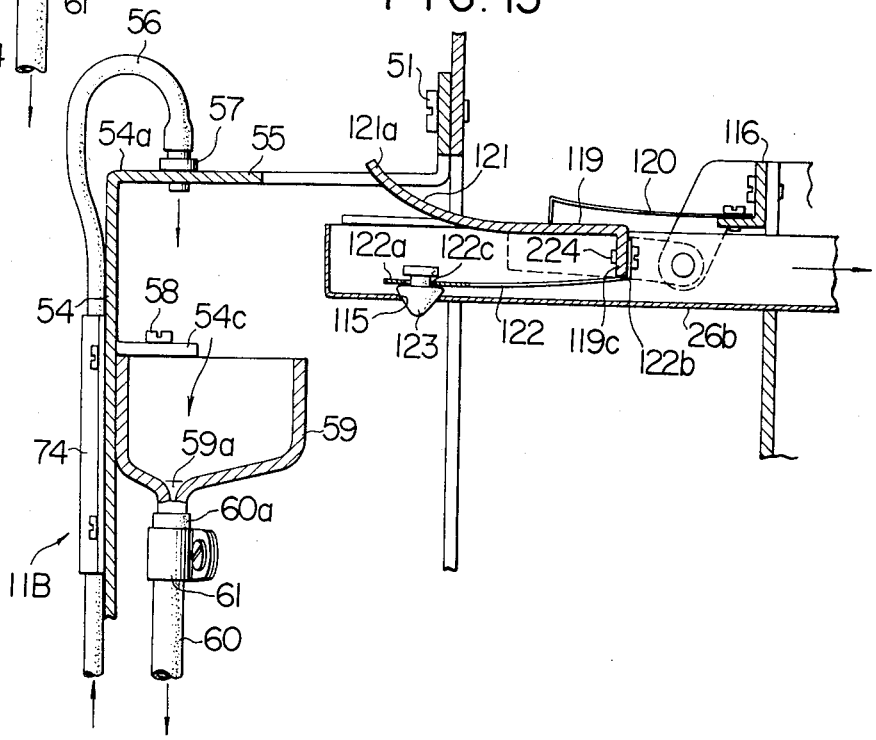
FIG. 15 is a schematic sectional side view of the container of FIG. 13 when the drain hole of FIG. 14 is closed.

The stopper 123 is made of an oil resistant material, such as urethane rubber, and serves to open or close the drain hole 115 formed at the end portion of the oil course 162 of the oil container 26. The stopper 123 is held by the elastic plate 122 with an upper portion of the stopper 123 passed through a slot 122*c* of the elastic plate 122 and the position of the stopper in the slot 122*c* is adjustable in order that the stopper 123 can be fitted appropriately in the drain hole 115 as shown in FIGS. 5 and 15.

The bias of the flat spring 120 is set greater than that of the elastic plate 122. Therefore, when the oil container 26 is moved away from the fixed mechanical portion 11B as shown in FIG. 15, the flat spring 120 pushes the cam follower device 119 counterclockwise and the stopper 123 is fitted into the drain hole 115 by the bias of the elastic plate 122, whereby the drain hole 115 is closed.

On the end plates 22, 23 of the movable mechanical portion 11A (only one end plate 23 is shown in FIG. 4), there is mounted a top plate 124 so as to be swingable about a support shaft 125. Therefore, the top plate 124 can be opened. To the lower surface of the top plate 124, there is fixed an oil supply felt 128 by a holding member 126 and a screw 127. One end portion 129*b* of an oil draw-up felt 129 is in contact with one end portion 128 of the oil supply felt 128, and the other end portion 129*a* of the oil draw-up felt 129 is immersed in an oil 130 in the oil course 162 of the oil container 26. The oil draw-up felt 129 is held by both a downwards bent portion 126*a* of the holding member 126 and a holding member 131 being fastened by a screw 132.

The other end portion 128*b* of the oil supply felt 128 is folded back at an edge 126*b* of the holding member 126, so that the end portion 128*b* is directed counter to the rotation of the oil supply roller 110 and in contact with the peripheral surface of the oil supply roller 110. The larger the area where a folded back portion 128*c* of the felt 128 is in contact with the peripheral surface of the oil supply roller 110, the more efficiently and smoothly the oil supply is effected. The edge 126*b* and a punched inwardly bent porton 126*c* of the holding member 126 are both bent downwards.

One side portion of the top plate 124 is bent so as to form a grooved portion 124*a* (see FIG. 3). The grooved portion 124*a* is provided with a plurality of fastening screws 134 with springs 133 attached thereto. Between the end plates 22 and 23, there is supported a fixing member 135 (see FIG. 4), and the top plate 124 can be fastened on the fixing member 135 with the fastening screws 134.

When fastening the top plate 124 on the fixing member 135 with the fastening screws 134, the folded-back portion 128*c* of the oil supply shaft 128 is positioned so as to come in contact with the surface of the oil supply roller 110 as broadly as possible. By such fastening of the top plate 124, the back side of the folded-back portion 128*c* can be pushed by the edge 126*b* and the inwardly bent portion 126*c* of the holding member 126, and the folded-back portion 128*c* is brought into pressure contact with the oil supply roller 110, and at the same time, the oil supply roller 110 is brought into pressure contact with the oil application roller 107.

Figure 18:
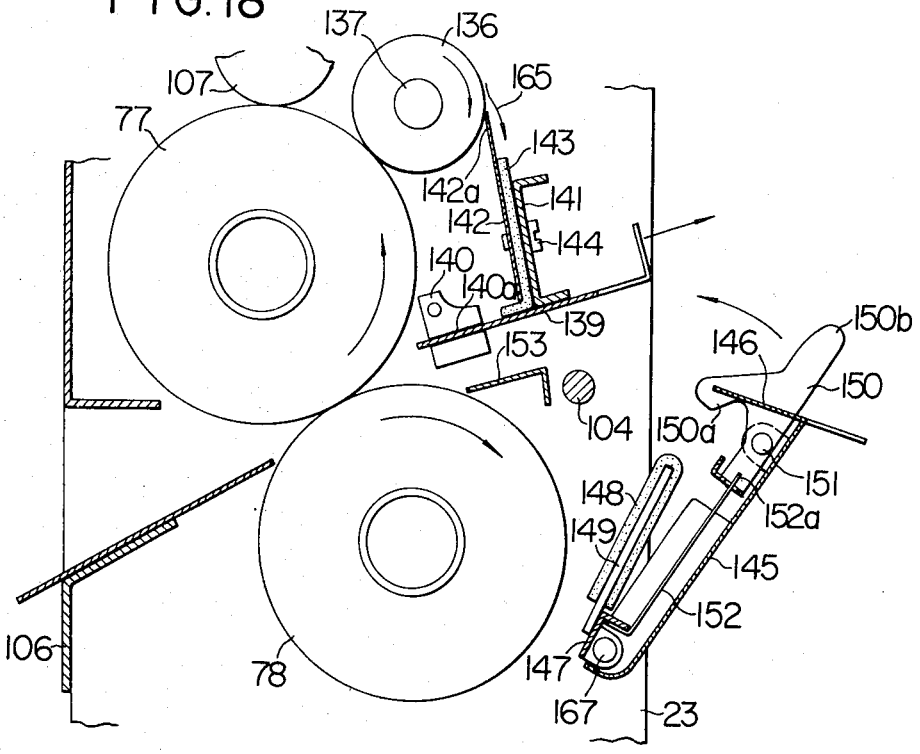
FIG. 18 is a schematic sectional side view of a cleaning apparatus for use with the oil supply apparatus of the present invention.

Referring to FIGS. 4 and 18, a cleaning roller 136 is in contact with the peripheral surface of the image fixing roller 77. The cleaning roller 136 is rotatably supported between the end plates 22, 23 through a shaft 137 of the cleaning roller 136. On one end of the shaft 137, there is mounted a gear 138 through a one-way clutch (not shown), and the gear 138 is engaged with the gear 85 of the image fixing roller 77 (see FIG. 3). The peripheral surface of the cleaning roller is coated with Teflon S (trademark).

Figure 19:
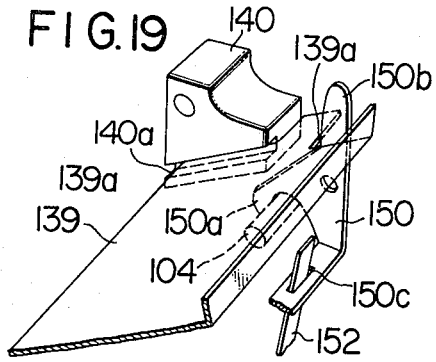
FIG. 19 is a perspective view of a recording sheet guide plate in FIG. 18.

To the end plates 22, 23, there are fixed support member 140 (one member is shown in FIG. 19) which support detachably a recording sheet guide plate 139 by holding the opposite edge portions 139*a* of the recording sheet guide plate 139 with supporting grooves 140*a* of the support members 140.

A support member 141 is fixed to the recording sheet guide plate 139. To the support member 141, there are fixed, by a screw 144, a cleaning blade 142 whose one side edge 142*a* is in contact with the peripheral surface of the cleaning roller 136, and a cleaning blade wick or felt 143 capable of absorbing oil. The cleaning blade 142 and the felt 143 are as wide as an effective cleaning width of the cleaning roller 136.

Referring to FIGS. 4 and 18, to each of the end plates 22, 23 (one end plate is shown in FIG. 18), there is fixed a pin 167. On the pin 167, there is pivotally mounted a side plate 145 which constitutes part of a side plate of the movable mechanical portion 11A, so that the side plate 145 can be opened. An uppermost portion of the side plate 145 is bent inwardly and the inwardly bent portion constitutes a guide plate 146 which forms a path for transporting recording sheets in combination with the guide plate 139.

On the pin 167, there is rotatably mounted a support frame 147, to which a support plate 149 covered with a cleaning felt 148 is fixed.

On the opposite end portions of the side plate 145 (one end portion is shown in FIG. 18), a stopping member 150 is swingably mounted through a fulcrum shaft 151. In the stopping member 150, there are formed an engagement arm 150*a* which is engageble with the support shaft 104, and a pressing arm 150*b* which is engageable with the recording sheet guide plate 139.

In a stopping hole 150*c* (see FIG. 19) formed in a lower bent portion of the stopping member 150, there is inserted a free end portion 152*a* of a plate spring 152 whose base portion is fixed to the support frame 147.

The side plate 145 is positioned as shown in FIG. 4 by the free end portion 152*a* of the stopping member 150 being engaged with the support shaft 104. When the side plate 145 is positioned as shown in FIG. 4, the cleaning felt 148 is brought into contact with the pressure application roller 78 and is then swung clockwise and accordingly the plate spring 152 is pushed in the same direction, whereby the stopping member 150 is biased to swing counterclockwise, so that the engagement arm 150*a* is engaged more firmly with the support shaft 104 and at the same time, the cleaning blade 142 is pushed so as to be brought into pressure contact with the cleaning roller 136 by the pressing arm 150*b* being engaged with the edge portion 139*a* of the recording sheet guide plate 139.

Therefore, the cleaning felt 148 which swings the plate spring 152 is brought into pressure contact with the peripheral surface of the pressure application roller 78 by the bias of the plate spring 152 since the free end portion 152*a* of the plate spring 152 is engaged with the stopping member 150.

As shown in FIGS. 4 and 5, under the recording sheet guide plate 139, there is disposed a lower guide plate 153 which is supported between the end plates 22, 23.

It has been explained that the movable mechanical portion 11A can be pulled out from the fixed mechanical portion 11B, and now a stopping means for stopping the movable mechanical portion 11A at a pushed-in position will be explained by referring to FIG. 9. One arm 24*a* (see FIG. 3) of a handle 24 is pivotally mounted on the frame 20, while the other arm 24*b* of the handle 24 is swingable with a notch 155 of the arm 24*b* engaged with a projection 154. In the arm 24*b*, there is formed a stepped portion 156 for engagement. A pin 157 fixed to the arm 24*b* is equipped with a torsion spring 158 whose one end 158*a* is engaged with the projection 154 and whose othe end 158*b* is engaged with a bent portion 159 of the arm 24*b*, so that the arm 24*b* is biased to move the stepped portion 156 upwards about the projection 154, viewed from the handle 24.

The body of the copying machine is provided with a stopping member 160 with which the stepped portion 156 can be engaged. In the stopping member 160, there is formed a stopping notch 160*a*. When the movable mechanical portion 11A is pushed in, the top portion of the arm 24*b* of the handle 24 is fitted into the stopping notch 160*a*, so that the stepped portion 156 is engaged with the stopping notch 160*a*. Therefore, unless the handle 24 is swung upwards, the movable mechanical portion 11A cannot be pulled out.

The operation of the thus constructed image fixing apparatus will now be explained. The movable mechanical portion 11A is mounted on the intermediate rail 15 as shown in FIG. 3 and is then pushed towards the fixed mechanical portion 11B. During the attachment of the movable mechanical portion 11A, the image fixing apparatus is deenergized unless a main switch of the copying machine is turned off.

When the movable mechanical portion 11A is pushed to a predetermined position, the gear 85 of the image fixing roller 77 is engaged with a connecting gear 35 of the driving apparatus 25 as shown in FIG. 11.

Figure 14:
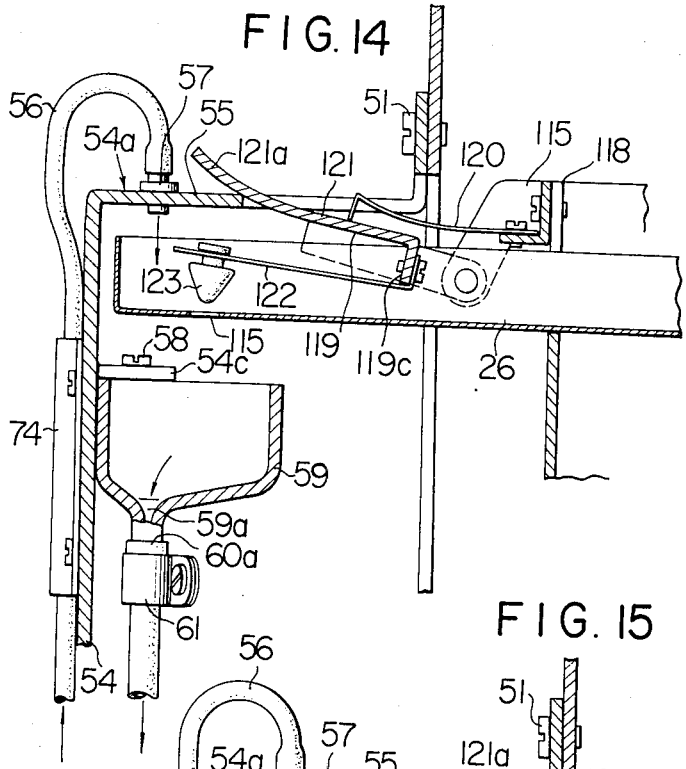
FIG. 14 is a schematic sectional side view of the oil container of FIG. 13 when a drain hole is opened.

Referring to FIG. 15, when the oil container 26 is moved to the left with the drain hole 115 closed by the stopper 123, the top portion 122*a* of the cam follower 121 is positioned above the cam 55, and when the oil container 26 is further pushed in, the top portion 122*a* and the cam 55 are engaged with each other as shown in FIG. 14.

When the cam follower 121 is engaged with the cam 55 and is swung against the bias of the flat spring 120, the elastic plate 122 is swung together with the cam follower 121 and the stopper 123 attached to the top portion 122*a* is pulled out from the drain hole 115, so that the drain hole 115 is opened. When the drain hole 115 is opened, the movable mechanical portion 11A is obviously pushed to a position where the drain hole 115 is located above the opening portion of the oil recovery container 59.

When the movable mechanical portion 11A is pushed up to a predetermined position, the image fixing roller 77 is connected to the driving apparatus 25 and the drain hole 115 of the oil container 26 is opened and the fixed side terminal 75 and the movable side terminal 76 for energizing the heaters 79 and 80 (see FIG. 4) are connected. At this moment, a starting portion 114 (see FIG. 12) of the oil course 161 of the oil container 26 is positioned under the oil outlet portion 57. The pushed-in position of the movable mechanical portion 11A is fixed by the stepped portion 156 of the arm 24*b* of the handle 24 being engaged with the stopping notch 160*a*.

The rotation of the standby motor 47 is continued when the image fixing apparatus is pulled out from the copying machine and when the image fixing apparatus is pushed to a right position, the image fixing apparatus is energized and the standby motor 47 is on standby.

When the standby motor 47 is rotated, the pump operation disc 46 is rotated, so that the pump operation rod 71 is reciprocated. When the pump operation rod 71 is reciprocated, the pressing member 69 (see FIGS. 6 and 8) is swung by and against the bias of the spring 68. By the swinging of the pressing member 69, the arm 69*a* of the pressing member 69 is brought into and out of contact with the flexible tube 65. Therefore, an elastic deformation of the flexible tube 65 is repeated, so that the oil in the oil tank 27 (see FIG. 3) is sucked through the pipe 73 by the action of the valves (not shown) built in the tubes 63, 64 and, at the same time, the oil is discharged from the oil outlet portion 57 to the starting portion 114 of the oil course 161 of the oil tank 26 through the flexible tube 65.

The above-mentioned oil sucking action is continued by the standby motor 47 which is in operation so long as the main switch (not shown) of the copying machine is on.

Figure 12:
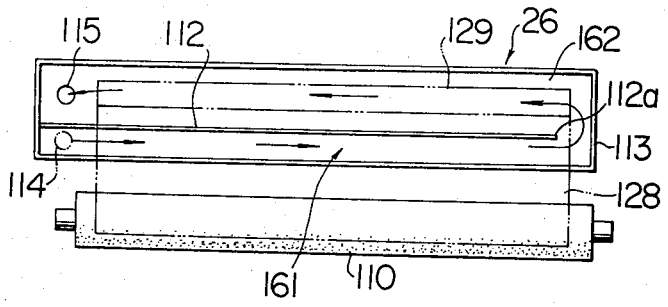
FIG. 12 is a schematic plan view of the oil course in the oil container for use in the oil supply apparatus of the present invention.
Figure 16:
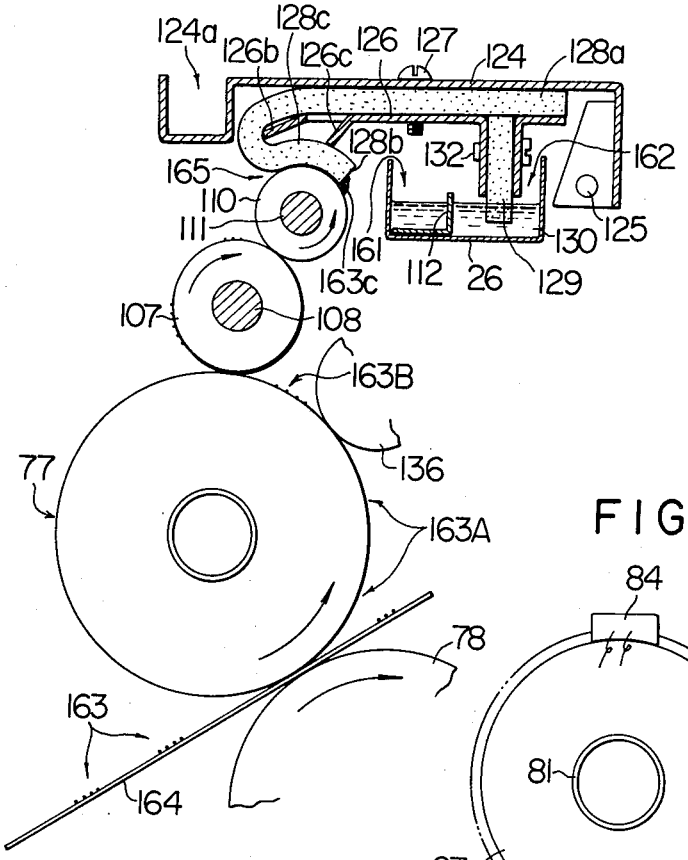
FIG. 16 is a schematic sectional side view of an oil application means for use with the oil supply apparatus of the present invention.

The oil 130 (see FIG. 16) discharged to the starting portion 114 of the oil course 162 of the oil container 26 is caused to flow from the oil course 161 to the oil course 162 in the direction of the arrows as shown in FIG. 12 and is then recovered into the oil tank 27 through the drain pipe 60 (see FIG. 10) from the drain hole 115. Since the end portion 129*a* of the oil draw-up felt 129 is disposed in the oil course 162 as shown in FIGS. 4 and 16, part of the oil 130 which flows in the oil course 162 is drawn up into the oil draw-up felt 129 by the capillarity of the felt 129.

The oil drawn up by the felt 129 passes through the oil supply felt 128 and reaches the oil supply roller 110 which is in pressure contact with the folded-back portion 128*c*.

The oil sucked by the pump into the oil container 26 soaks through the oil draw-up felt 129 when it flows through the oil course 162, and an excessive amount of the oil is discharged from the drain hole 115 into the oil tank 27. In other words, the oil is always circulated so that it is not heated by the heater 79 of the image fixing roller 77 and by the heater 80 of the pressure application roller 78. Therefore, an uneconomical evaporation and deterioration of the oil is obviated.

Therefore, the oil is supplied to the image fixing roller 77 without any change of the properties of the oil, so that a desired offset preventing effect of the oil can be obtained.

With the main switch (not shown) of the copying machine on, the oil supply apparatus begins to be operated and at the same time, the heaters 79, 80, which are respectively built in the image fixing roller 77 and the pressure application roller 78, are energized and start to heat the rollers 77, 78.

The standby motor 47, which starts to be rotated with the main switch on, rotates the image fixing roller 77 which has started to be heated, so that the image fixing roller 77 is heated uniformly.

The rotation of the standby motor 47 at a comparatively low speed is transmitted to the image fixing roller 77 through a gear train (see FIG. 11) comprising the gear 45, the large diameter gear 30, the one-way clutch 32, the gears 33, 34, 35 and 85, so that the image fixing roller 77 is rotated in the direction of the arrow as shown in FIGS. 4 and 16. In case the image fixing roller 77 is heated by the heater 79 while the the image fixing roller 77 is stopped, the heat of the image fixing roller 77 is absorbed by the oil applicaton roller 107 and by the cleaning roller 136 which are in contact with the image fixing roller 77, so that the temperature of the peripheral surface of the image fixing roller 77 differs from place to place. The same thing applies to the pressure application roller 78.

In particular, since the image fixing roller 77 and the pressure application roller 78 are respectively constructed of a heat pipe rollers, their pipe shafts and core metals may be heated excessively, without being in contact with the heating medium when the image fixing roller 77 and the pressure application roller 78 are stopped and heated. Therefore, it is very important to rotate the image fixing roller 77 and the pressure application roller 78 while they are heated.

By the low speed rotation of the image fixing roller 77, the pressure application roller 78 which is in pressure contact with the image fixing roller 77 is rotated in the direction of the arrow by the gears 85 and 91 which are engaged with each other. In other words, the image fixing roller 77 and the pressure application roller 78 are rotated so as to feed the recording sheets therebetween.

When the image fixing roller 77 is rotated, the oil application roller 107 and the cleaning roller 136, which are in pressure contact with the image fixing roller 77 and whose respective gears 109 and 138 are engaged with the gear 85, are rotated in the directions of the respective arrows as shown in FIG. 4.

As the oil application roller 107 is rotated, the oil supply roller 110 which is in pressure contact with the oil application roller 107 is rotated in the direction of the arrow, so that the oil supplied from the folded-back portion 128*c* of the oil supply felt 128 which is in contact with the upper portion of the oil supply roller 110 is transported to the surface of the oil application roller 107. The oil on the oil application roller 107 is coated on the image fixing roller 77 and further on the pressure application roller 78.

The oil application roller 107 is always rotated together with the image fixing roller 77 by the gears 109 and 85. However, the oil supply roller 110 which is in pressure contact with the oil application roller 107 slips on the oil application roller 107 and is not rotated when there is some oil between the two rollers 110 and 107. As the oil runs out between the oil application roller 107 and the oil supply roller 110, the oil supply roller 110 is driven by the oil application roller 107 since the coefficient of friction between the oil application roller 107 and the oil supply roller 110 is increased. In other words, the oil supply roller 110 is rotated only when there is little or no oil on the surface of the oil application roller 107 by the application of the oil to the image fixing roller 77, so that the oil is again supplied to the oil application roller 107 and the supply of the oil to the image fixing roller 77 is controlled. When an excessive amount of the oil is coated on the image fixing roller 77, the recording sheets are apt to be wound around the image fixing roller 77 or the recording sheets are smeared by the oil.

When the image fixing roller 77 is rotated as mentioned above during the so-called warm up time of the copying machine or a period of time before the copying machine becomes ready for copying after the main switch of the copying machine is on, the image fixing roller 77 and the pressure application roller 78 are uniformly heated by the heaters 79, 80.

The warm-up time is a period of time before heating the surface of the image fixing roller 77 up to a temperature necessary for fusing toner images on the image fixing roller 77. In the present image fixing apparatus, the temperature is detected by the temperature detecting element 84 which is in the contact with the temperature detecting portion 82*a* of the core metal 82 of the image fixing roller 77 (see FIG. 7). It is natural that there is a difference between the temperature of the temperature detecting portion 82*a* and that of the surface of the heat insulating elastic layer 83. Therefore, in controlling the temperature of the image fixing roller 77, the above-mentioned temperature difference is taken into consideration.

When a heat detecting element for detecting the temperature of the image fixing roller 77 is brought into contact with the elastic surface of the image fixing roller 77, the surface of the roller 77 is scratched in the peripheral direction thereof by the heat detecting element and the toner is apt to adhere to the scratched portion of the surface of the roller 77, so that offset of the toner occurs in the form of a narrow smear by the toner on the recording sheets in the transporting direction thereof, and the image fixing roller 77 is swelled by the oil, resulting in shortening the life of the roller 77. Therefore, in order to prevent the above-mentioned problem, the temperature detecting element 84 for controlling the temperature of the image fixing roller 77 is in contact with the bare portion of the core metal 82 as shown in FIG. 7.

When the copying machine is set in an operating condition by depressing a print button (not shown) after the warm-up time, the rotation of the main motor 41 (see FIG. 3) is transmitted to the driving apparatus 25.

As shown in FIG. 11, the rotation of the shaft 37 which is driven by the main motor 41 is transmitted to the gear 85 of the image fixing roller 77 through the gear train comprising the gears 36, 33, 34 and 35. The rotation of the shaft 37 is then transmitted from the gear 85 to the gears 91, 109 and 138 (refer to FIG. 3). Between the shaft 81 of the image fixing roller 77 and the gear 85, there is disposed the one-way clutch 166. Since the pipe shaft 88 of the pressure application roller 78 is rotated ingetrally with the gear 91, the pressure application roller 78 is driven by the main motor 41. Since the pressure application roller 78 is in pressure contact with the image fixing roller 77, the image fixing roller 77 is driven by the surface friction of the roller 77.

In the present image fixing apparatus, it may occur that the pressure application roller 78 slips on the image fixing roller 77 due to the oil existing between the two rollers 78 and 77, and that the image fixing roller 77 is not rotated normally, causing some disadvantage as will be explained later. Therefore, the image fixing roller 77 is rotated slightly slower in the peripheral speed than the pressure application roller 78 by the gear 85 through the one-way clutch 166.

This can be attained by the following construction. Supposing that the outer diameter of the image fixing roller 77 is $D_1$, the outer diameter of the pressure application roller $D_2$, the number of teeth of the gear 85 $N_1$, and the number of teeth of the gear 91 $N_2$, normally there must be a relationship of $D_1:D_1=N_1:N_2$. However, in order that the image fixing roller 77 is driven by the pressure application roller 78, the number of teeth of the gear 85 has to be increased in comparison with $N_1$, for instance, up to $N_1+1$. In this case, however, the shaft distance of the two rollers 77 and 78 does not coincide with the shaft distance of the two gears 85 and 91. This results in that the pressure application roller 78 cannot apply a pressure to the image fixing roller 77. Therefore, the gear having a $(N_1+1)$ teeth is converted to negative so that the diameter of the gear 85 is made equal to that of a pitch circle of $N_1$, whereby the shaft distance of the two rollers 77 and 78 is made equal to the shaft distance of the two gears 85 and 91.

In such a construction, the image fixing roller 77 is driven by the pressure application roller 78 whose diameter is little changed by the heat. Therefore, unlike a conventional system in which the image fixing roller 77 is driven forcibly, the recording sheets can be always transported at a constant speed without any slipping thereof and an excessive load is not applied to rubber adhesive layers of the two rollers 77 and 78.

When the image fixing roller 77 is in operation, it is rotated faster than when it is on standby. The rotation of the main motor 41 is not transmitted to the large diameter gear 30 through the one-way clutch 32, while the standby motor 47 is rotated at a low speed, performing the suction of the oil continuously.

When a recording sheet 164 to which toner images 163 have been transferred is fed between the image fixing roller 77 and the pressure application roller 78 as illustrated in FIG. 16, the toner images 163 are fused and pressed by the two rollers 77 and 78 and fixed to the recording sheet 164.

The image fixing roller 77 and the pressure application roller 78 are brought into pressure contact with each other, with the spacer 101 held between the bearing members 87 and 93 (one pair of the bearing members are shown in FIG. 17) provided at the opposite ends of the two rollers 77 and 78. Therefore, the heat insulating elastic layer 83 and the teflon layer 90, which directly contact with each other, are brought into pressure contact with each other uniformly in the respective axial directions thereof. Furthermore, since the two rollers 77 and 78 are heated uniformly while they are on standby, pressure and heat are applied uniformly to the recording sheets, so that a uniform image fixing can be effected. While the image fixing roller 77 and pressure application roller 78 are heated, their respective diameters may be changed. And the two rollers 77 and 78 are brought into pressure contact with each other at room temperature, and the contact pressure of the two rollers 77 and 78 set at room temperature is smaller than that of the two rollers 77 and 78 when they are heated. Therefore, the contact pressure of the two rollers 77 and 78 are adjusted so as to become optimum for image fixing when they are heated.

When the rollers 77 and 78 are exchanged with new ones or inspected, the movable mechanical portion 11A is pulled out of the body of the copying machine and the knob 105 (see FIG. 7) is pushed and rotated, so that the eccentric cams 102 and 103 are rotated, whereby the support arms 94 and 95 are released from the action of bringing the pressure application roller 78 into pressure contact with the image fixing roller 77.

Conventionally, the rollers 77 and 78 are brought into pressure contact with each other by spring means. However, when the spring means is employed, it is difficult to apply uniform pressure to the image fixing roller 77 in the axial direction thereof and to exchange or inspect the roller 77 and the pressure application roller 78. However, according to the mechanism as shown in FIG. 7, the two rollers 77 and 78 can be moved away from each other by a single rotating operation of the knob 105. Therefore, the exchanging and inspection of the two rollers 77 and 78 can be performed readily and speedily.

Furthermore, when the rollers 77 and 78 are brought into pressure contact with each other by spring means, the contact pressure between the two rollers 77 and 78 does not differ so much between when the copy machine is stopped and when image fixing is effected, the contact portions of the two rollers 77 and 78 are disadvantageously deformed. However, in the present image fixing apparatus, the pressure contact of the image fixing roller 77 and the pressure application roller 78 is effected by the operation of the knob 105, and when the copying machine is not in operation, the contact pressure applied to the two rollers 77 and 78 is smaller than that during the image fixing operation. Therefore, the deformation of the contact portions of the two rollers 77 and 78 is significantly small.

When the recording sheet 164 is passed between the rollers 77 and 78, the oil for offset preventing of the two rollers 77 and 78 adheres to the recording sheet 164 to some extent and is carried by the sheet 164. However, the oil is supplied successively to the rollers 77 and 78 from the oil supply felt 128 through the oil application roller 107 and the oil supply roller 110.

Although the oil is coated on the surface of the image fixing roller 77, a small amount ot the toner 163A is transported onto the roller 77. If the tone 163A is not removed from the surface of the roller 77, the toner 163A is transferred to the next recording sheet which comes in contact with the roller 77, so that the so-called offset phenomenon occurs or the back side of the recording sheet is smeared by the toner 163A when the toner 163A is transported to the pressure application roller 78.

Therefore, the cleaning roller 136 having a surface energy of causing the toner to adhere more to the cleaning roller 136 than to the roller 77 is brought into pressure contact with the roller 77, whereby the toner 163A is transported from the surface of the roller 77 to the cleaning roller 136 (see FIGS. 16 and 18).

The toner transported to the surface of the cleaning roller 136 is scraped together with the oil on the surface of the roller 136 by a top edge **142*a* of the cleaning blade 142, so that the toner is moved in the direction of the arrow 165 as shown in FIG. 18. The oil scraped by the cleaning blade 142 is absorbed by the felt 143. Since the teflon S coated on the surface of the cleaning roller 136 attracts the toner more than the silicone rubber of the image fixing roller 77, the toner can be easily transported to the cleaning roller 136. However, the toner adhering to the cleaning roller 136 can be readily removed by the cleaning blade 142. The cleaning roller 136 is abrasion resistant for such removal of the toner by the cleaning blade 142**.

A small amount of the toner 163B remaining on the image fixing roller 77 without being transported to the cleaning roller 136 is transported to the oil application roller 107 which has the same surface energy as that of the cleaning roller 136, and then to the oil supply roller 110.

The toner adhering to the oil supply roller 110 is scraped by the end portion **128*b* of the folded-back portion 128*c* of the oil supply felt 128 and is built up on the end portion 128*b* as indicated by reference numeral 163C in FIG. 16. By arranging the end portion 128*b* against the rotating direction of the oil supply roller 110 and by bringing the oil supply felt 128 into pressure contact with the oil supply roller 110 so as to have the contact area as large as possible, the oil supply action of the oil supply felt 128** can be maintained for a considerably long time.

In contrast to this, in case the end portion **128*b* of the oil supply felt 128 is directed towards the rotating direction of the oil supply roller 110, the toner on the oil supply roller 110 is hardly scraped by the end portion 128*b*, but it is removed at an inlet portion between the oil supply roller 110 and the oil supply felt 128. In FIG. 16, the inlet portion is represented by reference numeral 165, supposing that the oil supply roller 110 is rotated in the direction opposite to the arrow. However, the toner removed by the inlet portion 165 is moved deeper into the contact portion of the oil supply felt 128 and the oil supply roller 110 as the oil supply roller 110 is rotated and finally the toner is densely deposited on the contact portion of the oil supply felt 128, so that the oil supply felt 128** cannot supply the oil any longer.

In order to improve the scraping effect of the oil supply felt 128, the edge of the end portion 128*b* of the oil supply felt 128 is set normal to the surface of the oil supply roller 110. When removing the scraped toner from the oil supply felt 128 or inspecting the oil supply felt 128 itself, the fastening screws 134 (see FIG. 4) are unscrewed and the top plate 124 is opened. The toner scraping action and the oil supply action of the oil supply felt 128 can be adjusted by adjusting the fastening of the fastening screws 134.

During the standby time of the copying machine before the print button is depressed, the driving force of the main motor 41 is disconnected from the image fixing roller 77. However, so long as the main switch is on, since the standby motor 47 (see FIG. 3) is rotated, the image fixing roller 77 is rotated slowly and the above-mentioned cleaning action is continued.

The toner is transported to the pressure application roller 78 which is in pressure contact with the roller 77. However, the toner on the roller 78 is removed by the cleaning felt 148 (see FIG. 4) which is in pressure contact with the roller 78.

It is necessary to inspect the cleaning felt 148 and the felt 143 periodically. The inspection procedure of the cleaning felt 148 and the felt 143 is as follows. First, the movable mechanical portion 11A is pulled out of the body of the copying machine, and the side plate 145 is opened as indicated in FIG. 18, so that the cleaning felt 148 is inspected. Furthermore, the recording sheet guide plate 139, which is released from the stopping member by the opening of the side plate 145, is pulled out in the direction of the arrow, so that the felt 143 is inspected. After the top edge 142*a* of the cleaning blade 142 is cleaned, the recording sheet guide plate 139 is inserted back into the support members 140. When the inspection and exchange of the cleaning felt 148 and the felt 143 are finished, the side plate 145 is swung in the direction of the arrow, so that the engagement arm 150*a* of the stopping member 150 is engaged with the support shaft 140 as shown in FIG. 4. In accordance with this operation, the cleaning felt 148 is brought into pressure contact with the pressure application roller 78 by the plate spring 152, and the cleaning blade 142 is brought into pressure contact with the cleaning roller 136 by the recording sheet guide plate 139 being pushed by the pressing arm 150*b*.

As mentioned so far, the cleaning felt 148 and the cleaning blade 142 can be readily brought into pressure contact with each other and moved away from each other by the swinging operation of the side plate 145. Furthermore, by one plate spring 152, the respective positions of the cleaning felt 148, the cleaning blade 142 and the recording sheet guide plate 139 can be determined.

Referring to FIG. 14, when the movable mechanical portion 11A is pushed in, the oil container 26 is positioned so that the starting portion 114 of the oil course 161 and the drain hole 115 in the end portion of the oil course 162 are located under the oil outlet portion 57 and above the oil recovery container 59 and that the drain hole 115 is opened from which an excessive oil is discharged into the oil recovery container 59. When the movable mechanical portion 11A is pulled out, the cam follower 121 is detached from the cam 55 and the cam follower member 119 is swung by the bias of the flat spring 120. As the cam follower member 119 is swung, the elastic plate 122 is also swung in the same direction and the stopper 123 is fitted into the drain hole 115 so as to close the drain hole 115.

It is necessary that the drain hole 115 be closed by the stopper 123 while the drain hole 115 is still located above the oil recovery container 59. This can be accomplished by an appropriate setting of the engagement position of the top edge 121*a* of the cam follower 121 with the cam 55.

FIGS. 4 and 16 illustrate the oil 130 as if it exists considerably in amount in the oil container 26. However, the oil 130 sucked into the oil container 26 is successively discharged from the drain hole 115, there is not an excessive amount of the oil 130 in the oil container 26.

Since the drain hole 115 for recovering the oil is closed cooperatively with the pulling out of the movable mechanical portion 11A, the oil remaining in the oil container 26 does not smear the copying machine when the movable mechanical portion 11A is pulled out.

Furthermore, since the oil is circulated and an excessive amount of the oil does not exist in the oil container 26, the oil does not run over the side of the oil container 26. The same thing can be said when the copying machine is moved and it is unnecessary to remove the oil from the copying machine whenever the copying machine is moved and then to replenish the oil.

Figure 20:
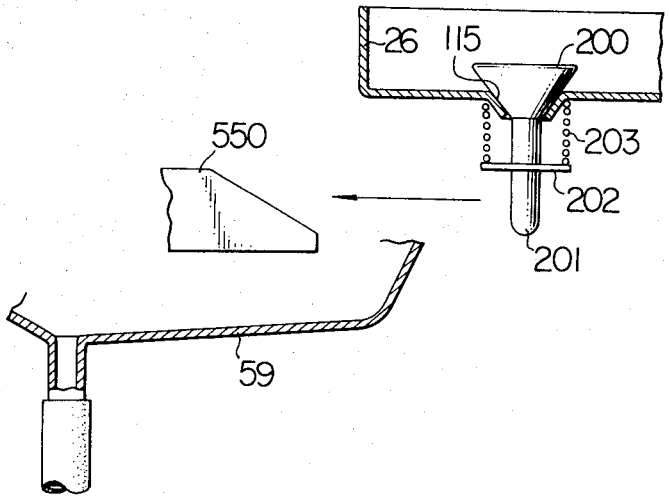
FIG. 20 is a schematic sectional side view of another means for closing the drain hole of FIG. 14.

Referring to FIG. 20, there is shown another opening and closing or value means for the drain hole 115. In FIG. 20, reference numeral 550 represents a fixed cam and reference numeral 200 represents a stopper. The stopper 200 is integrally provided with a cam follower 201 and a fixing plate 202 for fixing a spring 203. The stopper 200 is biased to close the drain hole 115 by the spring 203 equipped between the bottom surface of the oil container 26 and the fixing plate 202. When the oil container is pushed into the copying machine, the cam follower 201 collides with the cam 550 and is then moved upwards, so that the drain hole 115 is opened. The closing effect of the stopper 200 can be improved by making the stopper 200 conical.

Figure 21:
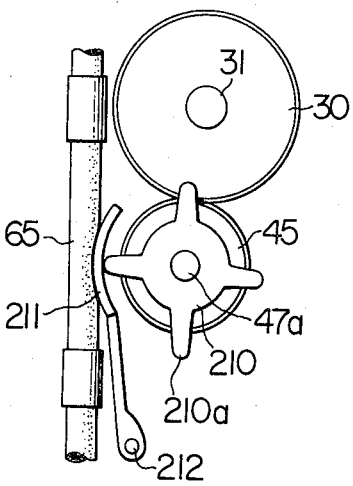
FIG. 21 is a schematic partial sectional side view of another means for operating the pump of FIG. 8.

Referring to FIG. 21, there is shown another example of a means performing the action of oil suction pump. To a shift 47*a* of the standby motor 47, there is fixed a pushing member 210 having pushing projection 210*a* thereon. In the rotation path of the pushing projections 210*a*, there is disposed a striking member 211 which is swingable about a support shaft 212. Within the swingable angle range of the striking member 211, there is disposed the flexible tube 65 which is highly elastic. By the slow rotation of the standby motor 47, the pushing projections 210*a* deform the tube 65 elastically through the striking member 211, so that the oil in the oil tank 27 (see FIG. 3) is sucked. In this example, the sucking pump means is directly operated by the driving shaft of the standby motor 47.

While specific embodiments of the invention have been shown and described in detail to illustrate the application of the principles of the invention, it will be understood that the invention may be embodied otherwise without departing from such principles.

What is claimed is:

1. An offset preventing oil supply device for a heat type image fixing apparatus of a copying machine for operation to make copies comprising:

an image fixing roller rotatably mounted in the copying machine;

a pressure roller rotatably mounted in the copy machine engageable in pressure contact with said image fixing roller to fix an image on the copy sheet moved therebetween;

an oil container for containing a replaceable supply of offset preventing oil associated with said image fixing roller, having an oil course defined therein forming a path for the replaceable supply of oil;

oil supply means between said oil container course and said image fixing roller for supplying oil in small quantities and for evenly distributing the oil on said image fixing roller;

an oil tank for containing a supply quantity of offset preventing oil associated with said oil container;

pump means connected between said oil tank and said oil container for drawing oil from said tank and supplying it to said container at one end of said oil course;

said oil container including a drain at one opposite end of said oil course for draining the oil from said container, whereby a replaceable supply of oil is maintained in said oil container course; said pump means actuated when the copying machine is in operation for providing a flow of the oil in the container to continuously apply the oil in a non-deteriorated state to said image fixing roller through said oil supply means.

2. A device according to claim 1 further including drive means connected to said image fixing roller for rotating said image fixing roller, means connected between said image fixing roller and said pressure roller for rotating said pressure roller slightly faster than the rotation of said image fixing roller when said image fixing roller is rotated.

3. A device according to claim 2 wherein said drive means comprises a standby motor rotatable at a relatively slow speed for constantly rotating said image fixing roller when the copying machine is activated, and a main motor for rotating said image fixing roller at a speed substantially faster than said former-mentioned speed, the copying machine including a print means for producing a photocopy from an original connected to said main motor for activating said main motor only when a copy is being produced from an original in the copying machine.

4. A device according to claim 1 wherein said pump means comprises a supply pipe connected between said tank and said container having an outlet portion adjacent said one end of said oil course, a flexible tube portion in said supply pipe deformable to displace oil within said supply pipe, at least one check valve in said supply pipe for permitting flow of oil in said supply pipe toward said outlet portion only, and flexible tube deforming means for deforming said flexible tube and supplying oil to said outlet portion and to said one end of said oil portion of said container in dripwise fashion.

5. A device according to claim 4 wherein said tube deforming means comprises a pressing member pivotally mounted adjacent said flexible tube having a portion abuttable against said flexible tube for deforming it, said device further including standby motor means connected to said image fixing roller for rotating it at a slow speed when the copying machine is activated, said pressing member connected to said standby motor means for supplying oil to said container in dripwise fashion when the copying machine is activated.

6. A device according to claim 4 wherein said flexible tube deforming means comprises a striking member mounted for movement against said flexible tube, pushing means having projections thereon rotatably mounted adjacent said striking member for intermittently deforming said flexible tube, standby motor means connected to said pushing member for rotating said pushing member and supplying oil to said container in dripwise fashion.

7. A device according to claim 1 further including at least one bearing connected to said pressure roller for rotatably mounted said pressure roller, a support arm having a support hole for accepting said bearing, said support arm being movable in the copying machine and including a cam contact portion, a cam movably mounted in the copying machine and engaged with said cam contact portion of said support arm for moving said support arm and said bearing of said pressure roller, said pressure roller being movable by the movement of said cam away from said image fixing roller whereby said pressure roller can be inspected are removed from the copying machine.

8. A device according to claim 7 further including at least one additional being connected to said image fixing roller rotatably mounted adjacent said former mentioned bearing for said pressure roller, said bearings both being of diameters less than said respective image fixing roller and pressure roller, and a spacer between said bearings for defining a minimum spacing therebetween and a maximum pressure of said pressure roller against said image fixing roller.

9. A device according to claim 1 wherein said image fixing roller, said pressure roller and said oil container are mounted in a movable mechanical portion of the copying machine which is movable away from a fixed mechanical portion which includes said oil tank, said oil supply means, and said pump means; a stopper disposable into and out of said drain of said oil container, a cam connected to one of said fixed mechanical portion and said stopper, and a cam follower connected to the other of said fixed mechanical portion and said stopper for engaging said stopper into said drain and closing the draining of the oil within said container when said movable mechanical portion is moved away from said fixed mechanical portion and for removing said stopper from said drain for permitting the flow of oil through said container when said movable mechanical portion is engaged with said fixed mechanical portion.

10. A device according to claim 9 wherein said cam comprises a part of said fixed mechanical portion, a spring plate connected to said stopper and pivotally mounted for rotation on said oil container, said cam follower connected to said spring member, and a strong spring plate engaged with said cam follower for biasing said stopper into said spring.

11. A device according to claim 9 further including a cam rod connected to said stopper, a spring connected between said cam rod and said oil container for biasing said stopper into said drain, and a cam surface defined on said fixed mechanical portion abuttable against said cam rod for displacing said stopper out of said drain.

12. A device according to claim 1 further including a funnel disposed below said drain of said container and opposed to said outlet portion of said oil supply pipe, and a drain pipe connected between said funnel and said oil tank for returning oil from said oil container to said oil tank.

13. A device according to claim 1 wherein said oil supply means between said oil container course and said image fixing roller comprises an oil application roller abutting said image fixing roller and rotatably mounted in the copying machine, drive means connected to said image fixing roller and said oil application roller for rotating said image fixing roller with said oil application roller, an oil supply roller abutting said oil application roller and mounted for free rotation, and a oil absorbent wick connected between said oil container course and said oil supply roller for supplying oil to said oil application roller which in turn supplies oil to said image fixing roller whereby said oil supplying roller rotates only when insufficient oil is present in said oil application roller.

14. A device according to claim 13 wherein said wick contacts said oil supply roller in portion bent in a direction away from the direction or rotation of said oil supply roller, said wick including an edge extending away from said oil supply roller whereby material on said oil supply roller is scraped therefrom by said edge.

15. A device according to claim 14 wherein said wick edge extends normally to a peripheral surface of said oil supply roller.

16. A device according to claim 1 further including a heater in said image fixing roller for heating said image fixing roller, said image fixing roller comprising a metal tube with a resilient layer thereover, said metal tube having a portion uncovered by said resilient layer, and a temperature sensor abutting said image fixing roller on said uncovered portion of said metal tube for sensing the temperature thereof, and control means connected between said sensor and said heater for maintaining a selected temperature of said image fixing roller.

17. A device according to claim 13 further including a cleaning roller abutting said image fixing roller, a cleaning blade abutting said cleaning roller for cleaning the surface thereof and an oil absorbing wick associated with said cleaning blade for absorbing oil scraped from the surface of said cleaning roller.

18. A device according to claim 1 further including cleaning felt means pivotally mounted in the copying machine adjacent said pressure roller, pivotable into a cleaning position with said cleaning felt means abutting the surface of said pressure roller for cleaning it.

19. An oil supply apparatus as claimed in claim 1, wherein said container is separated from a first section and a second section by a partition plate and said first section and said second section are connected for allowing said offset preventing liquid to flow from said first section to said second section, offset liquid recovery means for recovering excessive amount of offset preventing oil from said container to said tank, and said second section has said drain for discharging said offset preventing oil therefrom into said offset liquid recovery means.

20. An oil supply apparatus for use with a copying maching comprising a tank for holding an offset preventing liquid, a pump means for sucking said offset preventing liquid from said tank, a container for holding said offset preventing liquid sucked by said pump means, an offset preventing liquid application means for applying said offset preventing liquid to an image fixing roller, said offset preventing liquid application means disposed between said container and said image fixing roller, and an offset preventing liquid recovery means for recovering an excessive amount of said offset preventing liquid from said container into said tank, said container ring separated from a first section and a second section by a partition plate and said first section and said second section connected for allowing the offset preventing liquid to flow from said first section to said second section, and said second section having a drain hole for discharging the offset preventing liquid therefrom into said offset liquid recovery means.

* * * * *